US005082185A

United States Patent [19]

Evans

[11] Patent Number: 5,082,185

[45] Date of Patent: Jan. 21, 1992

[54] SPRAY WAND WITHOUT LIQUID LEAKAGE

[75] Inventor: William E. Evans, Jacksonville, Fla.

[73] Assignee: Roussel Uclaf, France

[21] Appl. No.: 591,701

[22] Filed: Oct. 2, 1990

[51] Int. Cl.[5] ..... B05B 7/12; B05B 7/04

[52] U.S. Cl. ..... 239/416.5; 239/433; 239/525; 239/532

[58] Field of Search ..... 239/433, 525, 526, 416.5, 239/417.3, 583, 432, 532

[56] References Cited

U.S. PATENT DOCUMENTS 1,736,357 11/1929 Norgren ..... 239/417.3
2,156,783 5/1939 Hovey et al. ..... 239/433
2,984,419 5/1961 McOuat ..... 239/525

*Primary Examiner*—Andres Kashnikow
*Assistant Examiner*—Lesley D. Morris
*Attorney, Agent, or Firm*—Bierman and Muserlian

[57] ABSTRACT

An assembly for dispensing a liquid composition in spray form including a wand section wherein fluid is transported through a capillary tube disposed within an outer tube, pressurized air being transported between the inside diameter of the outer tube and the outside diameter of the capillary tube. Both the outer tube and capillary tube connect with a common mixing chamber wherein the pressurized air and liquid is mixed, this mixture being expelled through a nozzle as an aerosol spray.

6 Claims, 2 Drawing Sheets

1
3
3a
3b
3c
3d
3e
4a
4b
4c
4d
4e
4f
4g
4h
4i
4j
4k
5
5a
5b
7
8
10
10a
10b
10c
10d
11
11a
15
15a
15b
15c
16
16a

SPRAY WAND WITHOUT LIQUID LEAKAGE

FIELD OF THE INVENTION

The present invention relates to a compressed air sprayer and, more particularly, to an improved spraying wand which prevents the leakage of liquids after the sprayer is shut off.

DESCRIPTION OF THE PRIOR ART

Prior art compressed air sprayers consisted of a liquid reservoir, under hand pumped pressure, connected to a hand held wand. The wand included a handle with a metal tube connected thereto and a hand actuated valve mechanism in the vicinity of the handle. A dispensing nozzle was disposed at the end of a ⅜" tube approximately 12" from the handle. When the spraying was stopped, the metal tube was filled with liquid and air under pressure, and since the nozzle orifice was smaller than the connecting tube, excess fluid in the tube under pressure would leak from the tip of the wand after the shut off valve, near the handle, had been closed. This created environmental problems and loss of valuable spraying product.

One solution to this problem was to relocate the shut off valve mechanism adjacent, and immediately behind, the nozzle. Since the application wand is usually bent at, or near the nozzle end, a cable threaded at both ends was used to connect the hand actuated valve to the shut off mechanism via the inside of the connecting tube. Although effective for preventing leakage, this assembly was both complicated and delicate. Further, the placement of the shut off valve mechanism adjacent and immediately behind the nozzle shifted the center of gravity of the wand towards the tip, reducing both the balance and feel of the assembly.

OBJECTS OF THE INVENTION

It is, therefore, an object of the present invention to provide a spray wand capable of preventing liquid leakage after shut off with a minimal number of expensive and delicate moving parts. It is a further object of the invention to provide a no leak spray wand which maintains its center of gravity near the handle portion thereof.

These and other various objects and advantages of the present invention will become more fully apparent as the following description is read in conjunction with the accompanying drawings.

DETAILED DESCRIPTION OF THE INVENTION

Figure 1:
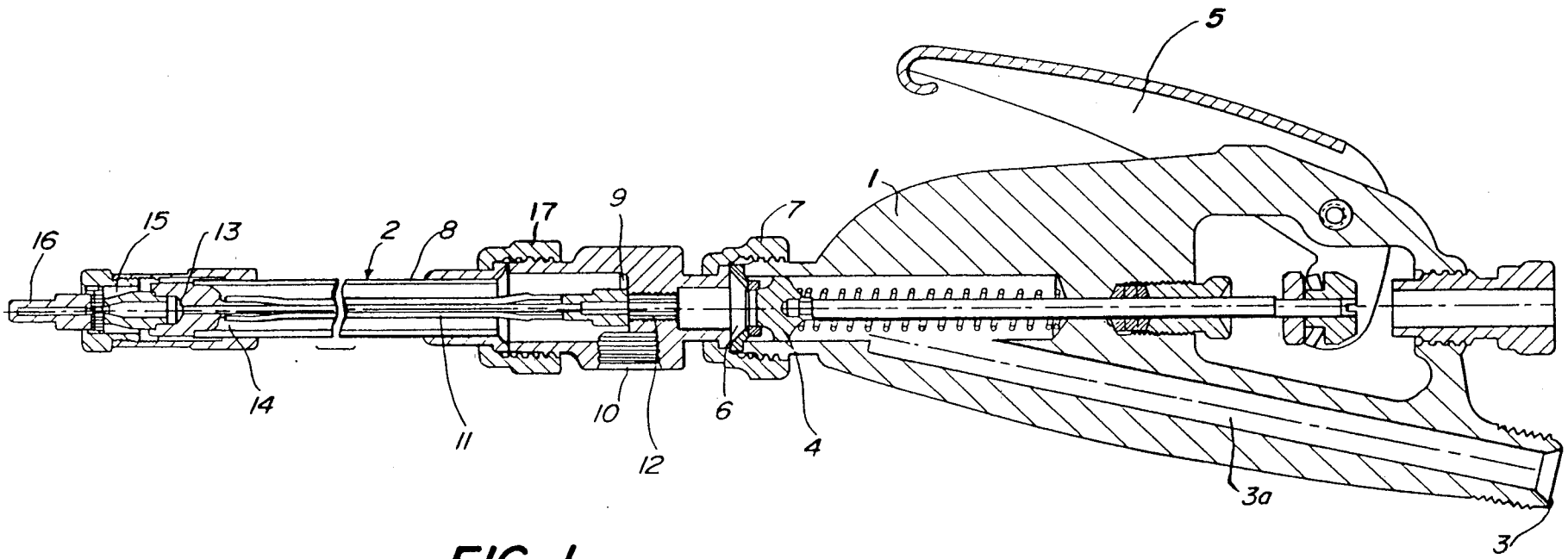
FIG. 1 is a side view, in section, of the inventive spray wand.

The inventive assembly, as shown in FIG. 1, constitutes two portions, a handle section 1 and an applicator wand section 2. Handle section 1 is supplied with fluid inlet 3 adapted to connect, through a hose (not shown) with an external liquid reservoir (not shown). Fluid flow through the duct 3*a* of the handle section 1 is controlled by valve means 4 actuated by actuating handle 5. When valve means 4 is open, fluid is transported through handle section 1 and is expelled through outlet 6.

Applicator wand section 2 attaches to outlet 6 via first lock nut 7. Wand section 2 is formed of an outer tube 8 having a sealed first end 9. Outer tube 8 is supplied with air via inlet 10 adapted to connect, through a supply hose (not shown) with an external pressurized air source (not shown).

Within outer tube 8 is disposed capillary tube 11 having a first end 12 passing through outer tube sealed first end 9 and communicating with fluid outlet 6. Both second end 13 of capillary tube 11 and second end 14 of outer tube 8 attach to mixing chamber 15. In mixing chamber 15, liquid transported through capillary tube 11 mixes with pressurized air supplied through outer tube 8 and the mixture is expelled through nozzle 16 as an aerosol spray. For ease of maintenance, wand 2 can be taken apart by using second lock nut 17.

Figure 2:
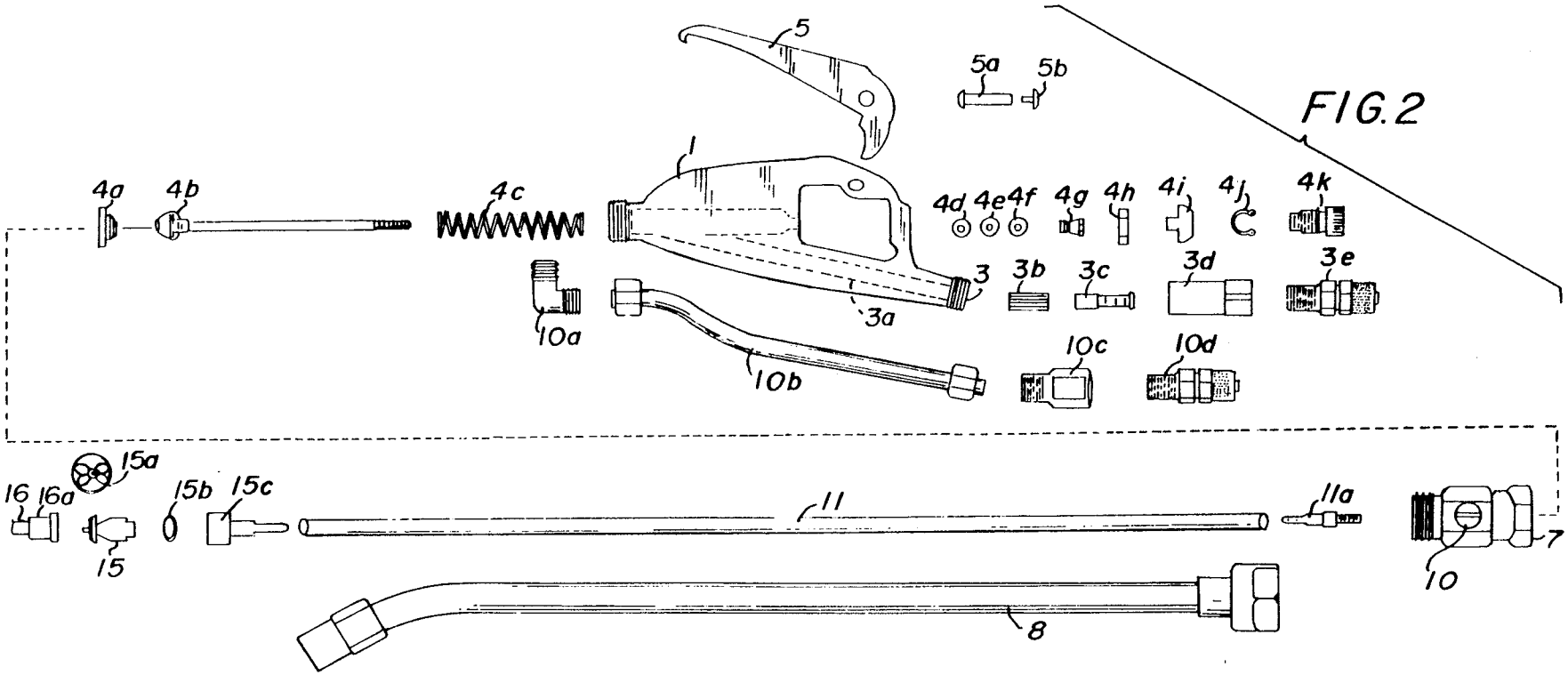
FIG. 2 is an exploded view of the invention

The exploded view of FIG. 2 illustrates the parts of the invention in more detail including handle parts 5*a* and 5*b*; valve parts 4*a*–4*k*, fluid inlet coupling parts 3*b*–3*e*; air inlet coupling parts 10*a*–*d*, mixing chamber parts 15*a*–*c*, nozzle parts 16*a*; as well as means for coupling capillary tube 11 to fluid outlet with coupling means 11*a*. These assemblies, by themselves, are not novel and will be understood by the artisan without additional explanation.

The capillary tube within an outer tube design of the invention allows for a less expensive method for educting both liquid and air through a single tube, while having the on/off valving located at the hand held position of the wand. The capillary tube is flexible enough to allow for easy insertion into the wand extension, usually ⅜" in diameter, and easily negotiates any bends that may be formed near the nozzle assembly. Since the capillary tubing more closely approximates the fluid flow capacity of the nozzle assembly, fluid is held static inside the capillary portion of the tubing and no dripping of fluid occurs once the on/off valve is closed. Thus, the flexible capillary tube within a tube construction eliminates the need for cables and interfacing devices for extending the on/off valve to the tip of the wand and prevents dripping so that no liquid is wasted. Additionally, the flexible capillary tubing design, at least in theory, can be used with any possible length. Thus, with only a simple change in the length of the inexpensive polyurethane tubing and the ⅜" diameter outside tubing, the wand can be extended to a length limited only by practicality. Further, as all valving mechanism remain in the handle portion, the balance of the wand gives it a perceived lighter weight allowing the operator to work with more precision and less fatigue.

Air atomization in the inventive device depends on pressure on the liquid line which must be sufficient to overcome the back pressure produced by the air passing over and through the mixing chamber to allow the flow of liquid to be atomized and expelled as an aerosol. This back pressure also aids in keeping all fluids in check when the valve is closed. Because of the exterior pressure of the air on the capillary tube, the capillary tube should be of at least 90 durometer to resist collapsing. A further advantage of the invention is that the capillary tube, when formed of the preferred polyurethane, will dissolve when highly active solvents, not specifically designed for the apparatus, are introduced into the system, causing wand failure before an operator can be harmed from continuous exposure thereto. While the invention can be used to spray any liquid, it was speficially designed for the application of pesticides.

While preferred embodiments have been shown and described, various modifications and substitutions may be made thereto without departing from the spirit and scope of the invention. Accordingly, it will be understood that the present invention is not to be limited except by the character of the claims appended hereto.

I claim:

1. An assembly for dispensing a liquid composition in spray form, said apparatus comprising;

a handle section having a duct therein, an inlet adapted to connect the duct, through a supply hose, to a liquid reservoir, an outlet through which said liquid in the duct is transported, and a means for controlling fluid flow through said outlet; and a wand section attachable to said handle section outlet, said wand section comprising an outer tube having a sealed first end adapted to attach, through a supply hose, to a pressurized air supply, and a capillary tube disposed within said outer tube, said capillary tube having a first end passing through the first end of said outer tube and communicating with said handle section outlet, both said outer tube and capillary tube having a second end attached to a common mixing chamber wherein said pressurized air from said outer tube mixes with said liquid from said capillary tube, the mixture being expelled from said mixing chamber through a nozzle as an aerosol spray.

2. The assembly of claim 1 wherein said capillary tube is polyurethane.

3. The assembly of claim 2 wherein said capillary tube is formed of polyurethane tubing having an outer diameter of about 0.125 inches.

4. The apparatus of claim 3 wherein said tubing is of at least 90 durometers.

5. The apparatus of claim 1 wherein said outer tube is a rigid tube having an outer diameter of at least 0.375 inches.

6. The assembly of claim 1 wherein said liquid being dispensed is a pesticide.

* * * * *